US007003831B1

(12) United States Patent
Goutevenier-Reyher

(10) Patent No.: US 7,003,831 B1
(45) Date of Patent: Feb. 28, 2006

(54) SECURED POSITION PILLOW

(76) Inventor: Elizabeth Goutevenier-Reyher, 81 Onderdonk Ave., Manhasset, NY (US) 11030

( * ) Notice: Subject to any disclaimer, the term of this patent is extended or adjusted under 35 U.S.C. 154(b) by 0 days.

(21) Appl. No.: 10/743,181

(22) Filed: Dec. 22, 2003

(51) Int. Cl.
*A47D 15/00* (2006.01)

(52) U.S. Cl. ..... 5/655; 5/633

(58) Field of Classification Search ..... 5/633, 5/655

See application file for complete search history.

(56) References Cited

U.S. PATENT DOCUMENTS 4,471,767 A * 9/1984 Guimond ..... 601/5
4,862,535 A * 9/1989 Roberts ..... 5/655
5,014,376 A * 5/1991 Doran et al. ..... 5/603
5,439,008 A * 8/1995 Bowman ..... 128/875
5,800,368 A * 9/1998 Klingemann et al. ..... 602/1
6,292,964 B1 * 9/2001 Rose et al. ..... 5/630

* cited by examiner

*Primary Examiner*—Michael Trettel
(74) *Attorney, Agent, or Firm*—Michael I. Kroll

(57) ABSTRACT

A pillow is disclosed for securely maintaining a user at a predetermined angle from a flat surface. The pillow includes an angled member having a triangular shape. The pillow further includes a securing member and means for connecting the securing member to the angled member at a first apex thereof. Upon connecting the securing member to the angled member, a user is positioned against the angled member and is secured thereto by the securing member and the user is maintained at the predetermined angle.

14 Claims, 8 Drawing Sheets

SECURED POSITION PILLOW

BACKGROUND OF THE INVENTION

1. Field of the Invention

The present invention relates generally to pillows and, more specifically, to a angled pillow for infants and children for aiding in the treatment of acid reflux disease and upper respiratory and head disorders. The pillow includes a triangular foam member and an H-shaped cloth wrap connected thereto. The foam member includes connection straps at an end opposite the connection of the cloth wrap for selectively connecting the pillow to a crib. The child is secured to the foam member using the cloth wrap. The pillow maintains the child at predetermined angle from the surface on which the child is positioned. By keeping the child at the predetermined angle, can then rest or digest after eating along with easing any discomfort related to acid reflux or flow back of foods. Also, the child can rest more comfortably when suffering from upper respiratory, head, and sinus congestion.

2. Description of the Prior Art

Numerous other pillows are known in the prior art. However, while these devices, may be suitable for the purposes for which they where designed, they would not be as suitable for the purposes of the present invention as heretofore described.

SUMMARY OF THE PRESENT INVENTION

The present invention relates generally to pillows and, more specifically, to an angled pillow for infants and children for aiding in the treatment of acid reflux disease and upper respiratory and head disorders. The pillow includes a triangular foam member and an H-shaped cloth wrap connected thereto. The foam member includes connection straps at an end opposite the connection of the cloth wrap for selectively connecting the pillow to a crib. The child is secured to the foam member using the cloth wrap. The pillow maintains the child at predetermined angle from the surface on which the child is positioned. By keeping the child at the predetermined angle, can then rest or digest after eating along with easing any discomfort related to acid reflux or flow back of foods. Also, the child can rest more comfortably when suffering from upper respiratory, head, and sinus congestion.

A primary object of the present invention is to provide a secured position pillow that overcomes the shortcomings of the prior art.

Another, secondary object of the present invention is to provide a secured position pillow for preventing acid reflux and upper respiratory and head congestion in infants and children.

Another object of the present invention is to provide a secured position pillow including an angular foam member for maintaining an infant in an angled position.

Yet another object of the present invention is to provide a secured position pillow wherein the foam member maintains the infant or child at an angle ranging between 20°–40°.

A further object of the present invention is to provide a secured position pillow including a cloth wrap connected to a first end for the foam member for securing the infant thereto.

Still another object of the present invention is to provide a secured position pillow wherein the cloth wrap is secured to the foam member with a zipper.

Yet a further object of the present invention is to provide a secured position pillow wherein the cloth member is H-shaped.

Another object of the present invention is to provide a secured position pillow wherein the cloth member includes hook and loop fasteners positioned at distal ends of the H-shaped cloth.

Yet another object of the present invention is to provide a secured position pillow wherein the zipper for connecting the H-shaped cloth is positioned in substantially the center of a first elongate member of the H-shaped cloth so that upon connection of the cloth, the member connecting the two elongate members of the H is positioned at substantially the midpoint of the foam member.

Another object of the present invention is to provide secured position pillow wherein the infant is positioned on and aligned with the member of the H-shape cloth wrap that connects the two elongated members of the H.

Still a further object of the present invention is to provide a secured position pillow wherein the elongated member of the H-shaped cloth having the zipper on a side there of is wrapped around the torso of an infant and secured using the hook and loop fasteners.

An even further object of the present invention is to provide a secured position pillow wherein the second elongated member of the H-shaped cloth is folding in a direction towards the infants torso and secured to the foam member by additional hook and loop fasteners.

Still yet another object of the present invention is to provide a secured position pillow wherein the cloth wrap and foam member are formed from a hypoallergenic material.

Yet another object of the present invention is to provide a secured position pillow that is simple and easy to use.

Still yet another object of the present invention is to provide a secured position pillow that is inexpensive to manufacture and operate.

Additional objects of the present invention will appear as the description proceeds.

The present invention overcomes the shortcomings of the prior art by providing an angled pillow for infants and children for aiding in the treatment of acid reflux disease and upper respiratory and head disorders. The pillow includes a triangular foam member and an H-shaped cloth wrap connected thereto. The foam member includes connection straps at an end opposite the connection of the cloth wrap for selectively connecting the pillow to a crib. The child is secured to the foam member using the cloth wrap. The pillow maintains the child at predetermined angle from the surface on which the child is positioned. By keeping the child at the predetermined angle, can then rest or digest after eating along with easing any discomfort related to acid reflux or flow back of foods. Also, the child can rest more comfortably when suffering from upper respiratory, head, and sinus congestion.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
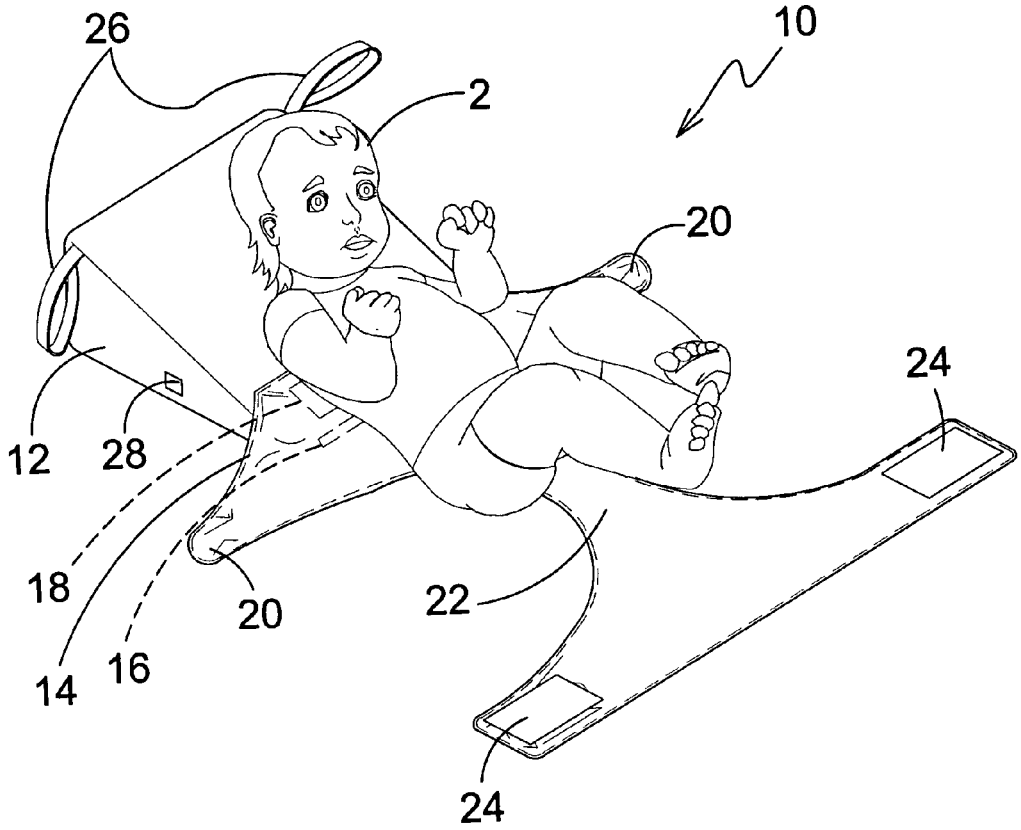
FIG. 1 is an illustrative view of the secured position pillow of the present invention in use.

Turning now descriptively to the drawings, in which similar reference characters denote similar elements throughout the several views, the Figures illustrate the secured position pillow of the present invention. With regard to the reference numerals used, the following numbering is used throughout the various drawing Figures.

10 pillow of the present invention
12 foam member
14 cloth wrap
16 zipper
18 first hook and loop fastener
20 second hook and loop fastener
22 connecting member
24 third hook and loop fasteners
26 connection loops
28 fourth hook and loop fasteners

DETAILED DESCRIPTION OF THE PREFERRED EMBODIMENT

The following discussion describes in detail one embodiment of the invention. This discussion should not be construed, however, as limiting the invention to those particular embodiments. Practitioners skilled in the art will recognize numerous other embodiments as well. For definition of the complete scope of the invention, the reader is directed to appended claims.

Turning now descriptively to the drawings, in which similar reference characters denote similar elements throughout the several views, FIGS. 1 through 8 illustrate a secured position pillow of the present invention indicated generally by the numeral 10 and hereinafter known as a "pillow".

FIG. 1 is an illustrative view of the secured position pillow of the present invention in use. The pillow 10 of the present invention includes a foam member 12 and a cloth wrap 14 selectively connected thereto. The foam member 12 is preferably triangular in shape and formed from hypoallergenic semi-rigid foam. The foam member is preferably a right triangular in shape whereby one angle of the triangle has a measurement ranging between 20° and 40°. The foam member 12 should be semi-rigid so as to maintain its triangular shape but also be comfortable for the infant or child resting thereon. The foam member 12 maintains the infant or child at an angle ranging between 20° and 40° from the surface on which the pillow 10 rests. The cloth wrap 14 is selectively connected to the foam member at an apex of the triangle at which the angle of the apex ranges between 20° and 40°. A zipper 16 is positioned on a side of the cloth wrap that is not in contact with the infant and selectively connects the cloth wrap 14 to the foam member. The cloth wrap 14 is used to maintain the child securely in position against the foam member 12. The foam member 12 ensures that the child in maintained in the angled position. The cloth wrap 14 is preferably H-shaped whereby one of the elongated members of the H has the zipper 16 positioned thereon. Thus, upon connecting the cloth wrap 14 to the foam member 12 via the zipper 16, a member connecting the two elongate members 22 of the H is positioned at substantially a midpoint of the foam member 12 and extends therefrom. The cloth wrap 14 includes a first hook and loop fasteners 18 positioned adjacent to the zipper 16. The cloth wrap 14 includes a second set of hook and loop fasteners 20 positioned at the distal end of the elongate member of the H connected to the foam member 12. The second set of hook and loop fasteners are positioned on a side opposite the zipper 16 and first hook and loop fasteners 18. A third set of hook and loop fasteners 24 are positioned at the distal ends of the second elongate member of the H-shaped cloth wrap 14. The third set fasteners 24 are positioned in the same side of the cloth wrap 14 as the second hook and loop fasteners 20. The foam member 12 also includes at least one connection loop 26. The connection loops 26 allow the foam member to be selectively connected to a piece of furniture such as a crib. The connection loops 26 may connect the foam member 12 to the furniture using at least one of hook and loop fasteners, buttons and snaps. The connection methods are described for purposes of example only and the connection loops 26 may use any method to securely connect the foam member to a piece of furniture.

As shown herein, an infant 2 is correctly positioned on the pillow 10 by aligning the spine of the infant with the connecting member 22 of the cloth wrap 14. The infant 2 is then positioned such that the second elongate member of the cloth wrap 14 can be folded in a direction towards the head of the infant 2 such that the connecting member 2 forms a seat for the infant 2. Securing the infant to the pillow 10 using the cloth wrap 14 will be discussed herein after with specific reference to FIGS. 3–8.

Figure 2:
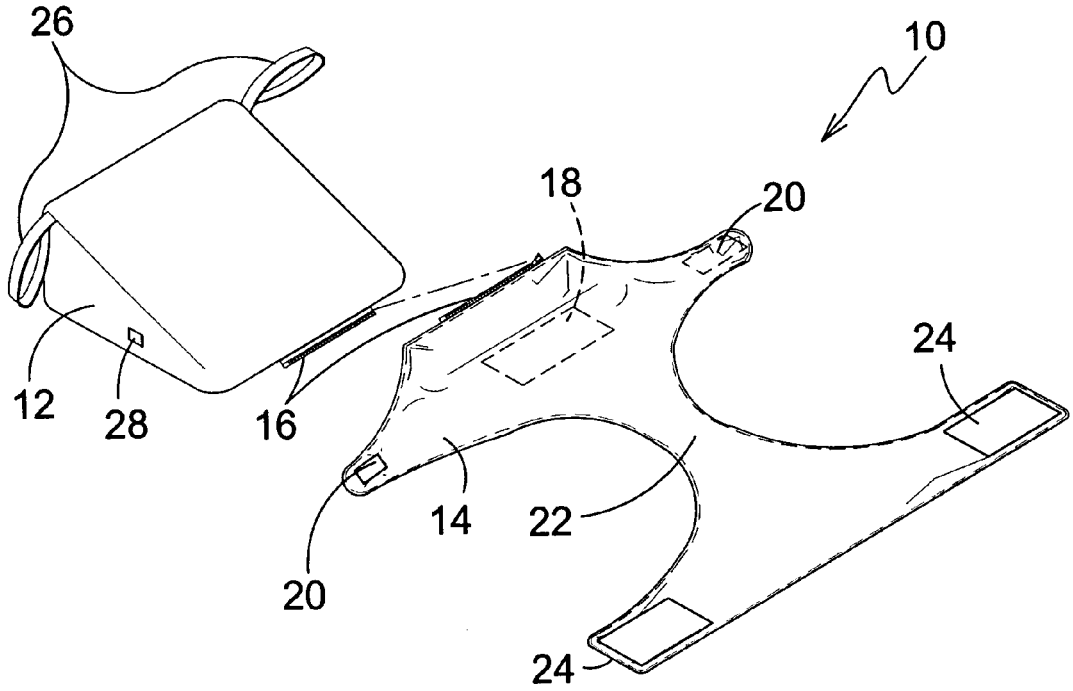
FIG. 2 is a perspective view of the secured position pillow of the present invention having the cloth wrap detached from the foam member.

FIG. 2 is a perspective view of the secured position pillow of the present invention having the cloth wrap detached from the foam member. The pillow 10 of the present invention includes the foam member 12 and the cloth wrap 14 selectively connected thereto. The foam member 12 is preferably triangular in shape and formed from hypoallergenic semi-rigid foam. The foam member 12 is preferably a right triangular in shape whereby one angle of the triangle has a measurement ranging between 20° and 40°. The foam member 12 should be semi-rigid so as to maintain its triangular shape but also be comfortable for the infant or child resting thereon. The foam member 12 maintains the infant or child at an angle ranging between 20° and 40° from the surface on which the pillow 10 rests. The cloth wrap 14 is selectively connected to the foam member at the apex of the triangle whereby the angle of the apex ranges between 20° and 40°. A zipper 16 is positioned on a side of the cloth wrap that is not in contact with the infant and selectively connects the cloth wrap 14 to the foam member 12. The cloth wrap 14 is used to maintain the child securely in position against the foam member 12. The foam member 12 ensures that the child in maintained in the angled position. The cloth wrap 14 is preferably H-shaped whereby one of the elongated members of the H has the zipper 16 positioned thereon. Thus, upon connecting the cloth wrap 14 to the foam member 12 via the zipper 16, the member connecting the two elongate members 22 of the H is positioned at substantially a midpoint of the foam member 12 and extends therefrom. The cloth wrap 14 includes the first hook and loop fasteners 18 positioned adjacent to the zipper 16. The cloth wrap 14 also includes the second set of hook and loop fasteners 20 positioned at the distal end of the elongate member of the H connected to the foam member 12. The second set of hook and loop fasteners are positioned on a side opposite the zipper 16 and first hook and loop fasteners 18. The third set of hook and loop fasteners 24 are positioned at the distal ends of the second elongate member of the H-shaped cloth wrap 14. The third set fasteners 24 are positioned in the same side of the cloth wrap 14 as the second hook and loop fasteners 20. The foam member 12 also includes the at least one connection loop 26. The at least one connection loop 26 allows the foam member to be selectively connected to a piece of furniture such as a crib. The at least one connection loop 26 may connect the foam member 12 to the furniture using at least one of hook and loop fasteners, buttons and snaps. The connection methods are described for purposes of example only and the at least one connection loop 26 may use any method to securely connect the foam member to a piece of furniture.

FIG. 2 shows the cloth member 14 disconnected from the foam member 12. Each of the foam member 12 and the cloth wrap 14 include one row of teeth of the zipper 16. The cloth wrap 14 is connected to the foam member 12 by aligning the matching teeth of the zipper 16. Upon zipping up the zipper 16, the cloth wrap is releaseably connected to the foam member 12. When the user would like to clean the cloth wrap 14, the user may unzip the zipper 16 thereby disconnecting the cloth wrap 14 from the foam member 12. Preferably, the cloth wrap is washable by at least one of a washing machine and by hand so that the cloth wrap remains clean.

Figure 3:
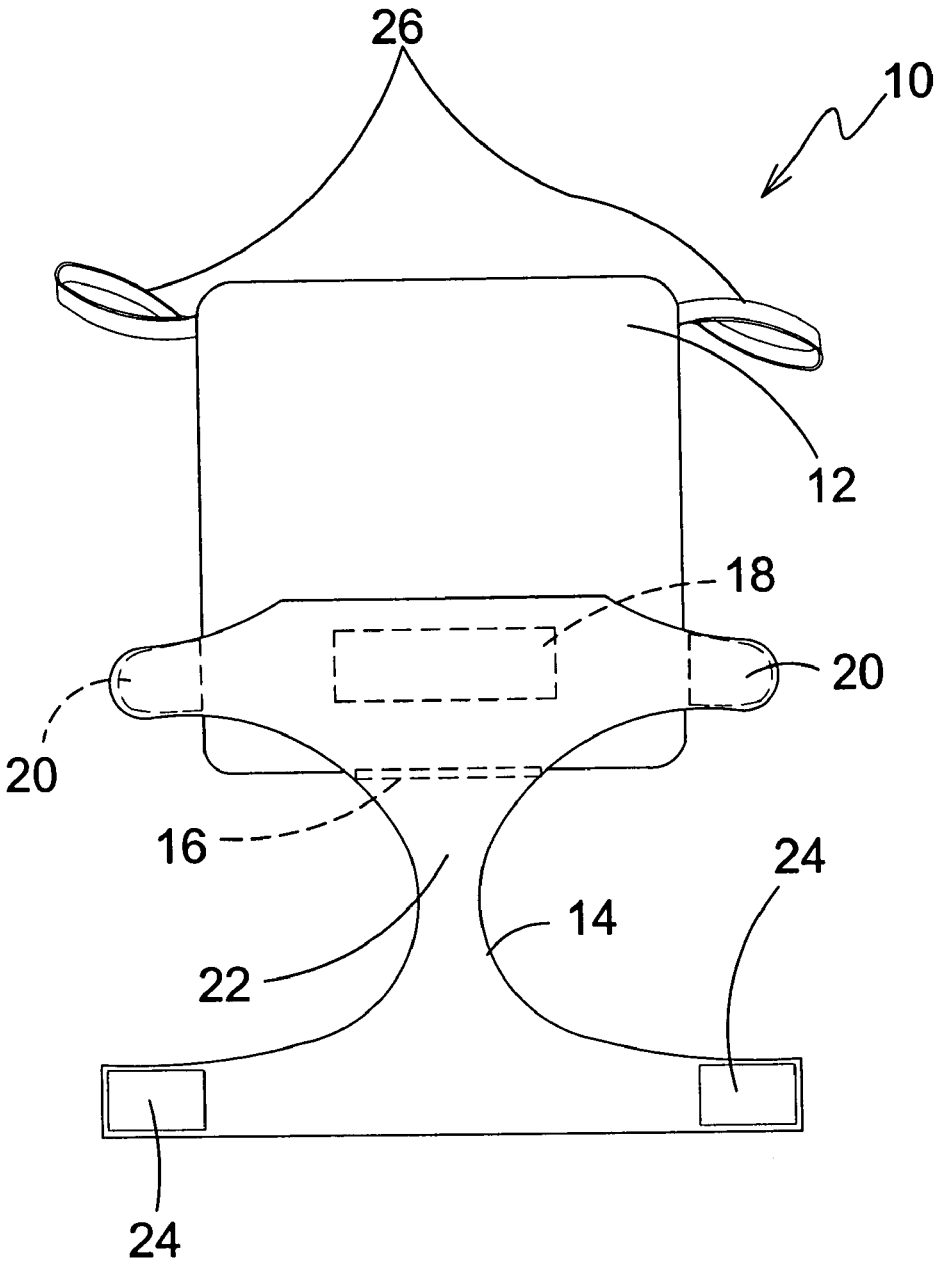
FIG. 3 is a top view of the secured position pillow of the present invention.

FIG. 3 is a top view of the secured position pillow of the present invention. The pillow 10 of the present invention includes the foam member 12 and the cloth wrap 14 selectively connected thereto. The foam member 12 is preferably triangular in shape and formed from hypoallergenic semi-rigid foam. The foam member 12 is preferably a right triangular in shape whereby one angle of the triangle has a measurement ranging between 20° and 40°. The foam member 12 should be semi-rigid so as to maintain its triangular shape but also be comfortable for the infant or child resting thereon. The foam member 12 maintains the infant or child at an angle ranging between 20° and 40° from the surface on which the pillow 10 rests. The cloth wrap 14 is selectively connected to the foam member at the apex of the triangle whereby the angle of the apex ranges between 20° and 40°. A zipper 16 is positioned on a side of the cloth wrap that is not in contact with the infant and selectively connects the cloth wrap 14 to the foam member 12. The cloth wrap 14 is used to maintain the child securely in position against the foam member 12. The foam member 12 ensures that the child in maintained in the angled position. The cloth wrap 14 is preferably H-shaped whereby one of the elongated members of the H has the zipper 16 positioned thereon. Thus, upon connecting the cloth wrap 14 to the foam member 12 via the zipper 16, the member connecting the two elongate members 22 of the H is positioned at substantially a midpoint of the foam member 12 and extends therefrom. The cloth wrap 14 includes the first hook and loop fasteners 18 positioned adjacent to the zipper 16. The cloth wrap 14 also includes the second set of hook and loop fasteners 20 positioned at the distal end of the elongate member of the H connected to the foam member 12. The second set of hook and loop fasteners are positioned on a side opposite the zipper 16 and first hook and loop fasteners 18. The third set of hook and loop fasteners 24 are positioned at the distal ends of the second elongate member of the H-shaped cloth wrap 14. The third set fasteners 24 are positioned in the same side of the cloth wrap 14 as the second hook and loop fasteners 20. The foam member 12 also includes the at least one connection loop 26. The at least one connection loop 26 allows the foam member to be selectively connected to a piece of furniture such as a crib. The at least one connection loop 26 may connect the foam member 12 to the furniture using at least one of hook and loop fasteners, buttons and snaps. The connection methods are described for purposes of example only and the at least one connection loop 26 may use any method to securely connect the foam member to a piece of furniture.

Figure 4:
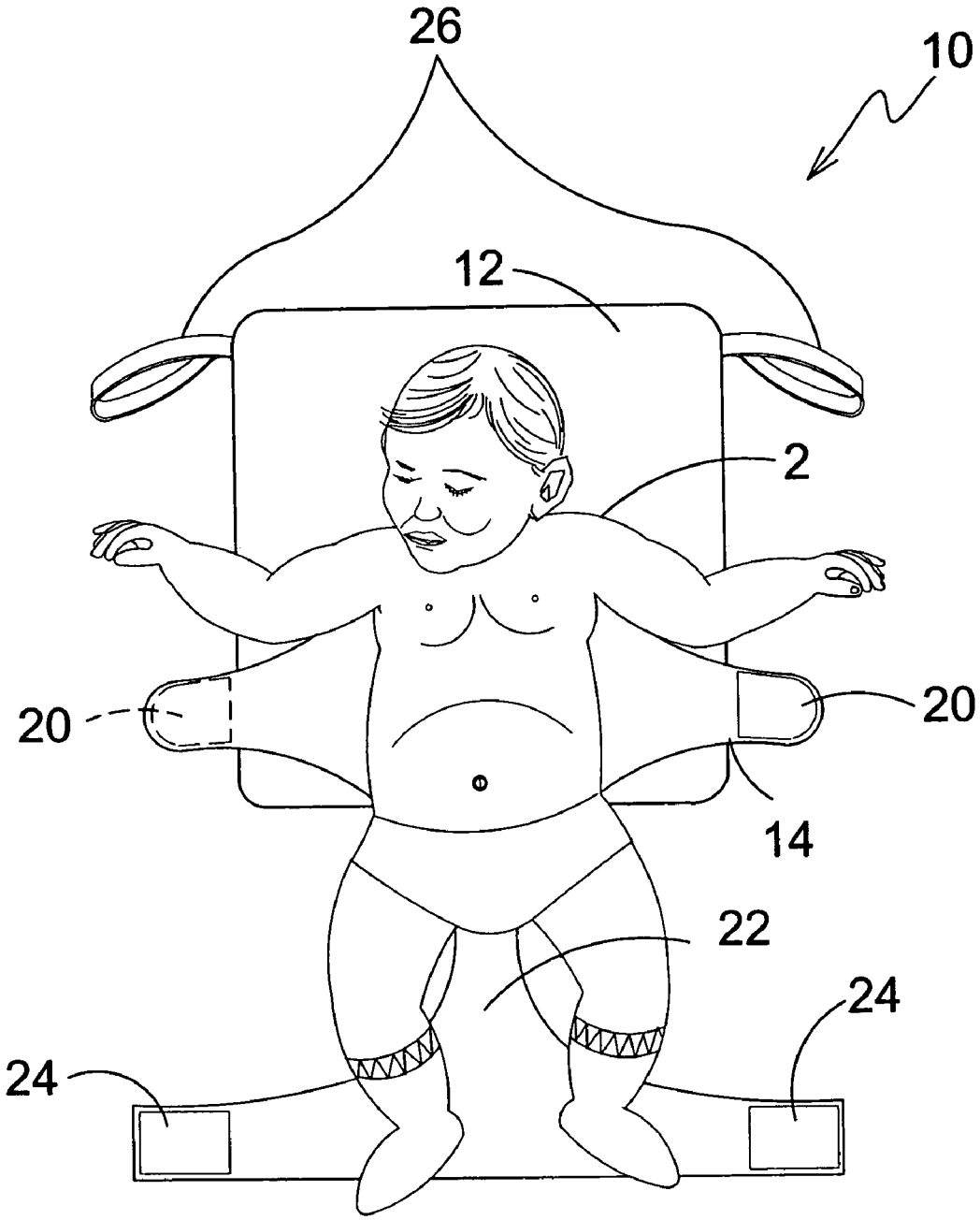
FIG. 4 is a top view of the secured position pillow of the present invention having an infant positioned thereon.

FIG. 4 is a top view of the secured position pillow of the present invention having an infant positioned thereon. The pillow 10 of the present invention includes the foam member 12 and the cloth wrap 14 selectively connected thereto. The foam member 12 is preferably triangular in shape and formed from hypoallergenic semi-rigid foam. The foam member 12 is preferably a right triangular in shape whereby one angle of the triangle has a measurement ranging between 20° and 40°. The foam member 12 should be semi-rigid so as to maintain its triangular shape but also be comfortable for the infant or child resting thereon. The foam member 12 maintains the infant or child at an angle ranging between 20° and 40° from the surface on which the pillow 10 rests. The cloth wrap 14 is selectively connected to the foam member at the apex of the triangle whereby the angle of the apex ranges between 20° and 40°. A zipper 16 is positioned on a side of the cloth wrap that is not in contact with the infant and selectively connects the cloth wrap 14 to the foam member 12. The cloth wrap 14 is used to maintain the child securely in position against the foam member 12. The foam member 12 ensures that the child in maintained in the angled position. The cloth wrap 14 is preferably H-shaped whereby one of the elongated members of the H has the zipper 16 positioned thereon. Thus, upon connecting the cloth wrap 14 to the foam member 12 via the zipper 16, the member connecting the two elongate members 22 of the H is positioned at substantially a midpoint of the foam member 12 and extends therefrom. The cloth wrap 14 includes the first hook and loop fasteners 18 positioned adjacent to the zipper 16. The cloth wrap 14 also includes the second set of hook and loop fasteners 20 positioned at the distal end of the elongate member of the H connected to the foam member 12. The second set of hook and loop fasteners are positioned on a side opposite the zipper 16 and first hook and loop fasteners 18. The third set of hook and loop fasteners 24 are positioned at the distal ends of the second elongate member of the H-shaped cloth wrap 14. The third set fasteners 24 are positioned in the same side of the cloth wrap 14 as the second hook and loop fasteners 20. The foam member 12 also includes the at least one connection loop 26. The at least one connection loop 26 allows the foam member to be selectively connected to a piece of furniture such as a crib. The at least one connection loop 26 may connect the foam member 12 to the furniture using at least one of hook and loop fasteners, buttons and snaps. The connection methods are described for purposes of example only and the at least one connection loop 26 may use any method to securely connect the foam member to a piece of furniture. As shown herein, an infant 2 is correctly positioned on the pillow 10 by aligning the spine of the infant with the connecting member 22 of the cloth wrap 14.

Figure 5:
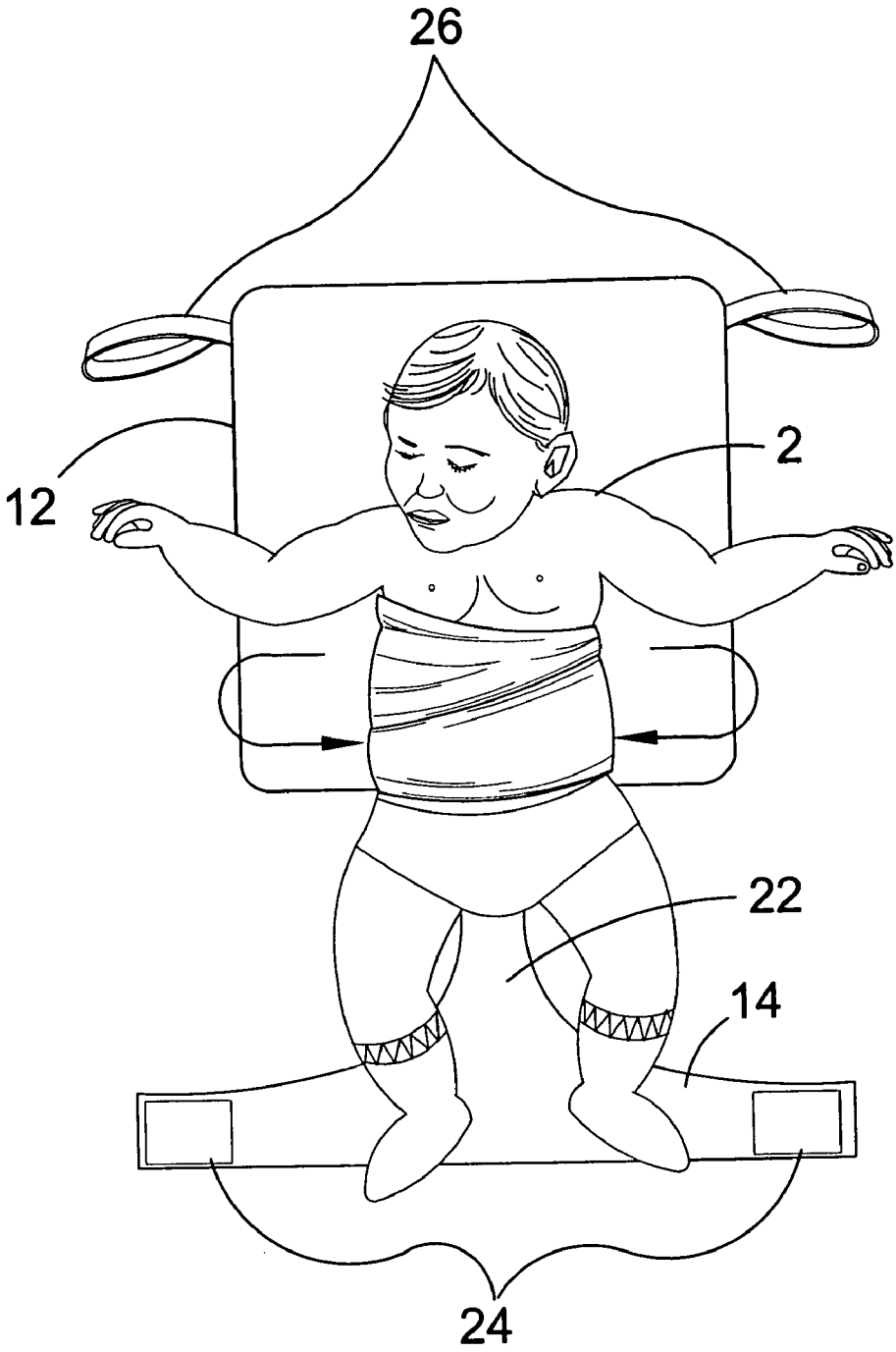
FIG. 5 is a top view of the secured position pillow of the present invention showing the infant being secured thereto.

FIG. 5 is a top view of the secured position pillow of the present invention showing the infant being secured thereto. The pillow 10 of the present invention includes the foam member 12 and the cloth wrap 14 selectively connected thereto. The foam member 12 is preferably triangular in shape and formed from hypoallergenic semi-rigid foam. The foam member 12 is preferably a right triangular in shape whereby one angle of the triangle has a measurement ranging between 20° and 40°. The foam member 12 should be semi-rigid so as to maintain its triangular shape but also be comfortable for the infant or child resting thereon. The foam member 12 maintains the infant or child at an angle ranging between 20° and 40° from the surface on which the pillow 10 rests. The cloth wrap 14 is selectively connected to the foam member at the apex of the triangle whereby the angle of the apex ranges between 20° and 40°. A zipper 16 is positioned on a side of the cloth wrap that is not in contact with the infant and selectively connects the cloth wrap 14 to the foam member 12. The cloth wrap 14 is used to maintain the child securely in position against the foam member 12. The foam member 12 ensures that the child in maintained in the angled position. The cloth wrap 14 is preferably H-shaped whereby one of the elongated members of the H has the zipper 16 positioned thereon. Thus, upon connecting the cloth wrap 14 to the foam member 12 via the zipper 16, the member connecting the two elongate members 22 of the H is positioned at substantially a midpoint of the foam member 12 and extends therefrom. The cloth wrap 14 includes the first hook and loop fasteners 18 positioned adjacent to the zipper 16. The cloth wrap 14 also includes the second set of hook and loop fasteners 20 positioned at the distal end of the elongate member of the H connected to the foam member 12. The second set of hook and loop fasteners are positioned on a side opposite the zipper 16 and first hook and loop fasteners 18. The third set of hook and loop fasteners 24 are positioned at the distal ends of the second elongate member of the H-shaped cloth wrap 14. The third set fasteners 24 are positioned in the same side of the cloth wrap 14 as the second hook and loop fasteners 20. The foam member 12 also includes the at least one connection loop 26. The at least one connection loop 26 allows the foam member to be selectively connected to a piece of furniture such as a crib. The at least one connection loop 26 may connect the foam member 12 to the furniture using at least one of hook and loop fasteners, buttons and snaps. The connection methods are described for purposes of example only and the at least one connection loop 26 may use any method to securely connect the foam member to a piece of furniture.

As shown herein, the infant 2 is correctly positioned on the pillow 10 by aligning the spine of the infant with the connecting member 22 of the cloth wrap 14. The infant 2 is then positioned such that the second elongate member of the cloth wrap 14 can be folded in a direction towards the head of the infant 2 such that the connecting member 2 forms a seat for the infant 2. The user takes each distal end of the first elongate member of the H-shaped cloth wrap 14 and wraps the end around the torso of the infant 2. The first hook and loop fasters 20 positioned at the distal ends of the first elongate member are secured by contacting the first hook and loop fasteners 18 as shown in FIGS. 1–3. By wrapping the first elongate member around the torso of the infant 2, the infant 2 is securely held against the foam member 12 of the pillow.

Figure 6:
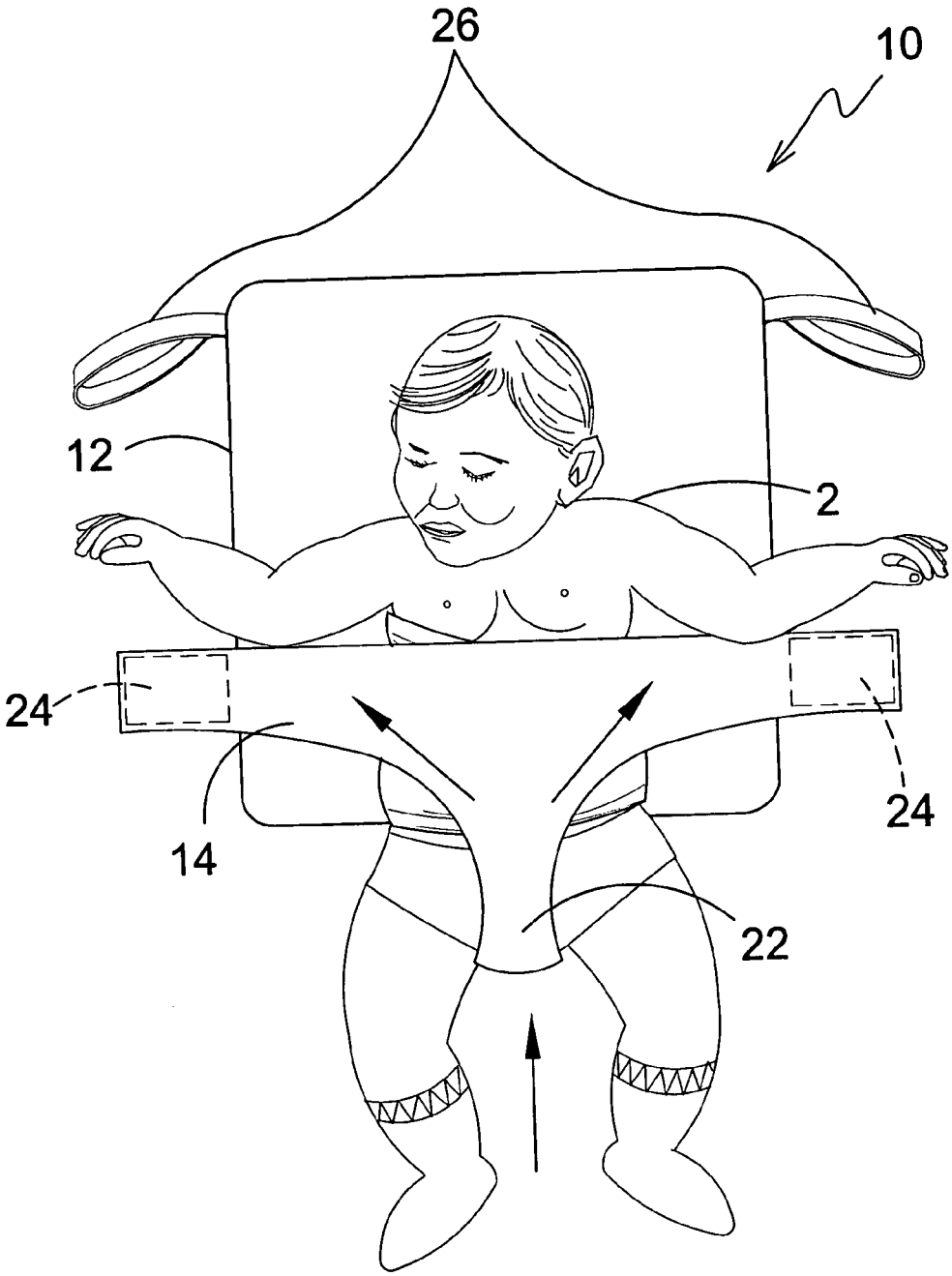
FIG. 6 is a top view of the secured position pillow of the present invention showing the infant being secured thereto.

FIG. 6 is a top view of the secured position pillow of the present invention showing the infant being secured thereto. The pillow 10 of the present invention includes the foam member 12 and the cloth wrap 14 selectively connected thereto. The foam member 12 is preferably triangular in shape and formed from hypoallergenic semi-rigid foam. The foam member 12 is preferably a right triangular in shape whereby one angle of the triangle has a measurement ranging between 20° and 40°. The foam member 12 should be semi-rigid so as to maintain its triangular shape but also be comfortable for the infant or child resting thereon. The foam member 12 maintains the infant or child at an angle ranging between 20° and 40° from the surface on which the pillow 10 rests. The cloth wrap 14 is selectively connected to the foam member at the apex of the triangle whereby the angle of the apex ranges between 20° and 40°. A zipper 16 is positioned on a side of the cloth wrap that is not in contact with the infant and selectively connects the cloth wrap 14 to the foam member 12. The cloth wrap 14 is used to maintain the child securely in position against the foam member 12. The foam member 12 ensures that the child in maintained in the angled position. The cloth wrap 14 is preferably H-shaped whereby one of the elongated members of the H has the zipper 16 positioned thereon. Thus, upon connecting the cloth wrap 14 to the foam member 12 via the zipper 16, the member connecting the two elongate members 22 of the H is positioned at substantially a midpoint of the foam member 12 and extends therefrom. The cloth wrap 14 includes the first hook and loop fasteners 18 positioned adjacent to the zipper 16. The cloth wrap 14 also includes the second set of hook and loop fasteners 20 positioned at the distal end of the elongate member of the H connected to the foam member 12. The second set of hook and loop fasteners are positioned on a side opposite the zipper 16 and first hook and loop fasteners 18. The third set of hook and loop fasteners 24 are positioned at the distal ends of the second elongate member of the H-shaped cloth wrap 14. The third set fasteners 24 are positioned in the same side of the cloth wrap 14 as the second hook and loop fasteners 20. The foam member 12 also includes the at least one connection loop 26. The at least one connection loop 26 allows the foam member to be selectively connected to a piece of furniture such as a crib. The at least one connection loop 26 may connect the foam member 12 to the furniture using at least one of hook and loop fasteners, buttons and snaps. The connection methods are described for purposes of example only and the at least one connection loop 26 may use any method to securely connect the foam member to a piece of furniture.

As shown herein, the infant 2 is correctly positioned on the pillow 10 by aligning the spine of the infant with the connecting member 22 of the cloth wrap 14. The infant 2 is then positioned such that the second elongate member of the cloth wrap 14 can be folded in a direction towards the head of the infant 2 such that the connecting member 2 forms a seat for the infant 2. The user takes each distal end of the first elongate member of the H-shaped cloth wrap 14 and wraps the end around the torso of the infant 2. The first hook and loop fasters 20 positioned at the distal ends of the first elongate member are secured by contacting the first hook and loop fasteners 18 as shown in FIGS. 1–3. By wrapping the first elongate member around the torso of the infant 2, the infant 2 is securely held against the foam member 12 of the pillow. Thereafter, the second elongate member of the H-shaped cloth wrap is folded in a direction towards the infants head. Upon folding the second elongate member, the connecting member 22 forms a seat for the infant and prevents the infant from sliding down the foam member 12. This is important in order to maintain the infant at the predetermined angle.

Figure 7:
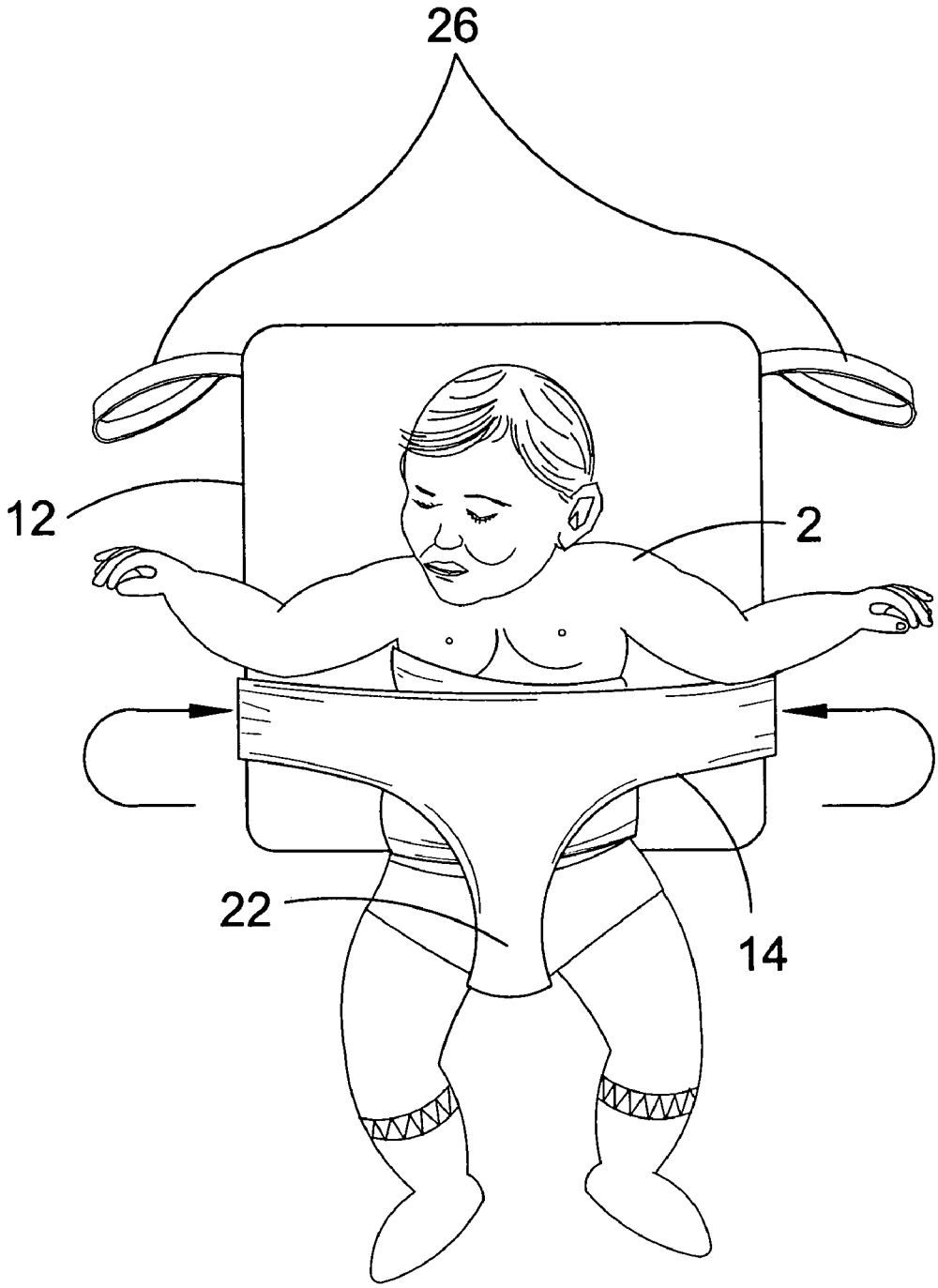
FIG. 7 is a top view of the secured position pillow of the present invention showing the infant being secured thereto.

FIG. 7 is a top view of the secured position pillow of the present invention showing the infant being secured thereto. The pillow 10 of the present invention includes the foam member 12 and the cloth wrap 14 selectively connected thereto. The foam member 12 is preferably triangular in shape and formed from hypoallergenic semi-rigid foam. The foam member 12 is preferably a right triangular in shape whereby one angle of the triangle has a measurement ranging between 20° and 40°. The foam member 12 should be semi-rigid so as to maintain its triangular shape but also be comfortable for the infant or child resting thereon. The foam member 12 maintains the infant or child at an angle ranging between 20° and 40° from the surface on which the pillow 10 rests. The cloth wrap 14 is selectively connected to the foam member at the apex of the triangle whereby the angle of the apex ranges between 20° and 40°. A zipper 16 is positioned on a side of the cloth wrap that is not in contact with the infant and selectively connects the cloth wrap 14 to the foam member 12. The cloth wrap 14 is used to maintain the child securely in position against the foam member 12. The foam member 12 ensures that the child in maintained in the angled position. The cloth wrap 14 is preferably H-shaped whereby one of the elongated members of the H has the zipper 16 positioned thereon. Thus, upon connecting the cloth wrap 14 to the foam member 12 via the zipper 16, the member connecting the two elongate members 22 of the H is positioned at substantially a midpoint of the foam member 12 and extends therefrom. The cloth wrap 14 includes the first hook and loop fasteners 18 positioned adjacent to the zipper 16. The cloth wrap 14 also includes the second set of hook and loop fasteners 20 positioned at the distal end of the elongate member of the H connected to the foam member 12. The second set of hook and loop fasteners are positioned on a side opposite the zipper 16 and first hook and loop fasteners 18. The third set of hook and loop fasteners 24 are positioned at the distal ends of the second elongate member of the H-shaped cloth wrap 14. The third set fasteners 24 are positioned in the same side of the cloth wrap 14 as the second hook and loop fasteners 20. The foam member 12 also includes the at least one connection loop 26. The at least one connection loop 26 allows the foam member to be selectively connected to a piece of furniture such as a crib. The at least one connection loop 26 may connect the foam member 12 to the furniture using at least one of hook and loop fasteners, buttons and snaps. The connection methods are described for purposes of example only and the at least one connection loop 26 may use any method to securely connect the foam member to a piece of furniture.

As shown herein, the infant 2 is correctly positioned on the pillow 10 by aligning the spine of the infant with the connecting member 22 of the cloth wrap 14. The infant 2 is then positioned such that the second elongate member of the cloth wrap 14 can be folded in a direction towards the head of the infant 2 such that the connecting member 2 forms a seat for the infant 2. The user takes each distal end of the first elongate member of the H-shaped cloth wrap 14 and wraps the end around the torso of the infant 2. The first hook and loop fasters 20 positioned at the distal ends of the first elongate member are secured by contacting the first hook and loop fasteners 18 as shown in FIGS. 1–3. By wrapping the first elongate member around the torso of the infant 2, the infant 2 is securely held against the foam member 12 of the pillow. Thereafter, the second elongate member of the H-shaped cloth wrap is folded in a direction towards the infants head. Upon folding the second elongate member, the connecting member 22 forms a seat for the infant and prevents the infant from sliding down the foam member 12. This is important in order to maintain the infant at the predetermined angle. Upon forming the seat for the infant, the third set of hook and loop fasteners 24 contact a mating fourth pair of hook and loop fasteners 28 positioned on the sides of the foam member 12 as shown in FIG. 1. When the second elongate member is secured to the foam member, the infant is securely and safely maintained in an angled position.

Figure 8:
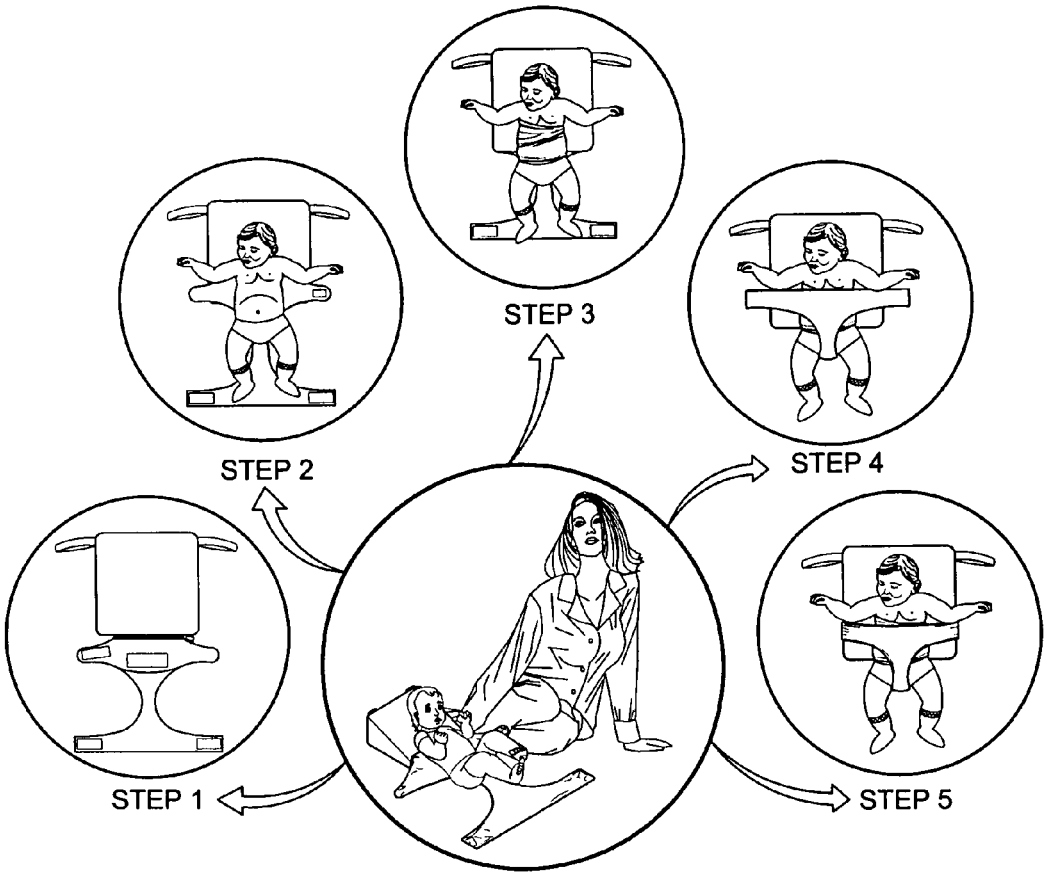
FIG. 8 is diagrammatic representation of the steps to secure an infant to the secured position pillow of the present invention.

FIG. 8 is diagrammatic representation of the steps to secure an infant to the secured position pillow of the present invention. The pillow 10 of the present invention includes the foam member 12 and the cloth wrap 14 selectively connected thereto. The foam member 12 is preferably triangular in shape and formed from hypoallergenic semi-rigid foam. The foam member 12 is preferably a right triangular in shape whereby one angle of the triangle has a measurement ranging between 20° and 40°. The foam member 12 should be semi-rigid so as to maintain its triangular shape but also be comfortable for the infant or child resting thereon. The foam member 12 maintains the infant or child at an angle ranging between 20° and 40° from the surface on which the pillow 10 rests. The cloth wrap 14 is selectively connected to the foam member at the apex of the triangle whereby the angle of the apex ranges between 20° and 40°. A zipper 16 is positioned on a side of the cloth wrap that is not in contact with the infant and selectively connects the cloth wrap 14 to the foam member 12. The cloth wrap 14 is used to maintain the child securely in position against the foam member 12. The foam member 12 ensures that the child in maintained in the angled position. The cloth wrap 14 is preferably H-shaped whereby one of the elongated members of the H has the zipper 16 positioned thereon. Thus, upon connecting the cloth wrap 14 to the foam member 12 via the zipper 16, the member connecting the two elongate members 22 of the H is positioned at substantially a midpoint of the foam member 12 and extends therefrom. The cloth wrap 14 includes the first hook and loop fasteners 18 positioned adjacent to the zipper 16. The cloth wrap 14 also includes the second set of hook and loop fasteners 20 positioned at the distal end of the elongate member of the H connected to the foam member 12. The second set of hook and loop fasteners are positioned on a side opposite the zipper 16 and first hook and loop fasteners 18. The third set of hook and loop fasteners 24 are positioned at the distal ends of the second elongate member of the H-shaped cloth wrap 14. The third set fasteners 24 are positioned in the same side of the cloth wrap 14 as the second hook and loop fasteners 20. The foam member 12 also includes the at least one connection loop 26. The at least one connection loop 26 allows the foam member to be selectively connected to a piece of furniture such as a crib. The at least one connection loop 26 may connect the foam member 12 to the furniture using at least one of hook and loop fasteners, buttons and snaps. The connection methods are described for purposes of example only and the at least one connection loop 26 may use any method to securely connect the foam member to a piece of furniture.

As shown herein, the infant 2 is correctly positioned on the pillow 10 by aligning the spine of the infant with the connecting member 22 of the cloth wrap 14. The infant 2 is then positioned such that the second elongate member of the cloth wrap 14 can be folded in a direction towards the head of the infant 2 such that the connecting member 2 forms a seat for the infant 2. The user takes each distal end of the first elongate member of the H-shaped cloth wrap 14 and wraps the end around the torso of the infant 2. The first hook and loop fasters 20 positioned at the distal ends of the first elongate member are secured by contacting the first hook and loop fasteners 18 as shown in FIGS. 1–3. By wrapping the first elongate member around the torso of the infant 2, the infant 2 is securely held against the foam member 12 of the pillow. Thereafter, the second elongate member of the H-shaped cloth wrap is folded in a direction towards the infants head. Upon folding the second elongate member, the connecting member 22 forms a seat for the infant and prevents the infant from sliding down the foam member 12. This is important in order to maintain the infant at the predetermined angle. Upon forming the seat for the infant, the third set of hook and loop fasteners 24 contact a mating fourth pair of hook and loop fasteners 28 positioned on the sides of the foam member 12 as shown in FIG. 1. When the second elongate member is secured to the foam member, the infant is securely and safely maintained in an angled position.

The pillow 10 of the present invention is a comfortable and safe treatment for acid reflux that may occur in infants or children. While the above description hereinabove with specific reference to FIGS. 1–8 details a pillow for an infant, the pillow may be sized accordingly to accommodate a larger child, an adolescent, or an adult. Additionally, other utility is found in the pillow of the present invention. The pillow 10 allows an infant or child to safely rest at an angle after ingesting food. Also, the pillow 10 may be used when an infant or a child is suffering from respiratory distress or a head or sinus infection. The pillow can effectively assist in the treatment of the above discussed ailments.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A pillow for securely maintaining a user at a predetermined angle from a flat surface, said pillow comprising:

a) an angled member having a triangular shape;

b) a securing member; and c) means for connecting said securing member to said angled member at a first apex thereof, wherein upon connecting said securing member to said angled member, a user is positioned against said angled member and is secured thereto by said securing member and the user is maintained at said predetermined angle, wherein said securing member is an H-shaped member, said H-shaped member includes:

i) a first elongate member having first hook and loop fasteners positioned adjacent to said connection means on a first side thereof, and a second hook and loop fasteners positioned at each distal end thereof on a side opposite said first hook and loop fasteners;

ii) a second elongate member having third hook and loop fasteners positioned at each distal end thereof on the same side as said second hook and loop fasteners; and iii) a connecting member for connecting said first elongate member and said second elongate member at substantially a midpoint thereof.

2. The pillow as recited in claim 1, wherein said angled member is a right triangle and an angle of said first apex ranges substantially between 20° and 40°.

3. The pillow as recited in claim 1, wherein the angled member is formed from semi-rigid, hypoallergenic foam.

4. The pillow as recited in claim 1, wherein said connection means is a zipper.

5. The pillow as recited in claim 1, wherein said first elongate member is able to be wrapped around a torso of the user and said second hook and loop fasteners and said first hook and loop fasteners are able to maintain the user in a desired position on said angled member when placed in contact.

6. The pillow as recited in claim 5, further comprising fourth hook and loop fasteners positioned on each side of said angled member.

7. The pillow as recited in claim 6, wherein said second elongate member is able to be folded in a direction towards the user and said connecting member forms a seat when positioned between the legs of the user.

8. The pillow as recited in claim 7, wherein said third hook and loop fasteners and said fourth hook and loop fasteners are able to retain the user in contact with said angled member when placed in contact.

9. The pillow as recited in claim 1, wherein said H-shaped member is cloth wrap.

10. The pillow as recited in claim 9, wherein said cloth is hypoallergenic.

11. The pillow as recited in claim 1, further comprising connection loops for connecting said pillow to a piece of furniture.

12. The pillow as recited in claim 11, wherein said connection loops are secured to the furniture by at least one of hook and loop fasteners, buttons and snaps.

13. The pillow as recited in claim 1, wherein said pillow is able to treat the effects of at least one of acid reflux disease, head congestion, and sinus congestion.

14. The pillow as recited in claim 1, wherein said pillow is able to aid in digestion of foods.

* * * * *